United States Patent [19]

Saito et al.

[11] Patent Number: 4,914,892

[45] Date of Patent: Apr. 10, 1990

[54] PROCESS FOR PACKAGING ARTICLE WITH FILM

[75] Inventors: Tsutomu Saito; Yukio Hosaka, both of Tokyo, Japan

[73] Assignee: Kabushiki Kaisha Fuji Seisakusho, Japan

[21] Appl. No.: 300,155

[22] Filed: Jan. 23, 1989

Related U.S. Application Data

[63] Continuation of Ser. No. 48,414, May 11, 1987, abandoned.

[30] Foreign Application Priority Data

May 12, 1986 [JP] Japan ..... 61-107846

[51] Int. Cl.[4] ..... B65B 9/02; B65B 11/08

[52] U.S. Cl. ..... 53/399; 53/463; 53/466; 53/479; 53/553; 53/586; 53/229

[58] Field of Search ..... 53/463, 466, 473, 553, 53/399, 379, 228, 229, 586

[56] References Cited

U.S. PATENT DOCUMENTS

| | | | |
|---|---|---|---|
| 1,266,686 | 5/1918 | Johnson | 53/229 |
| 1,702,325 | 2/1929 | Van Sickels | 53/463 X |
| 2,195,222 | 3/1940 | Neumair | 53/229 X |
| 2,281,582 | 5/1942 | Irmscher | 53/479 X |
| 2,612,740 | 10/1952 | Russell | 53/229 |
| 2,999,042 | 9/1961 | Master | 53/479 X |
| 3,589,091 | 6/1971 | Cloud | 53/463 X |
| 3,922,362 | 11/1975 | Pierce . | |
| 4,209,958 | 7/1980 | Bailey | 53/553 |
| 4,492,072 | 1/1985 | Miyano | 53/586 |

FOREIGN PATENT DOCUMENTS 2087174 12/1971 France .

*Primary Examiner*—John Sipos

*Attorney, Agent, or Firm*—Michael N. Meller

[57] ABSTRACT

This invention relates to a process for packaging an article with a thermoplastic resin film in which the film is rolled on the two rolls on both side so that an intermediate region thereof may be extended in tension condition between the rolls, and an article to be packaged is fed through a space between the rolls so as to push against the extended intermediate region of the film and be wrapped therewith, and overlapped portions of the wrapping film are set in parallel with the surface of the article and are fused together, and at the same time are cut so that there may be obtained such a fused adhesion line on the overlapped portions of the film that extends in the lateral width of the film and is longer in length than the width of the film, so that there is obtained the packaged article in which the fused overlapped portions of the packaging film is laid along on the surface of the article and, on the other hand, there is obtained an intermediate region of the film which is extended between the two rolls and has the foregoing fused overlapped portions.

8 Claims, 10 Drawing Sheets

FIG.4 EIG.4 FIG.4 FIG.4
A B C D
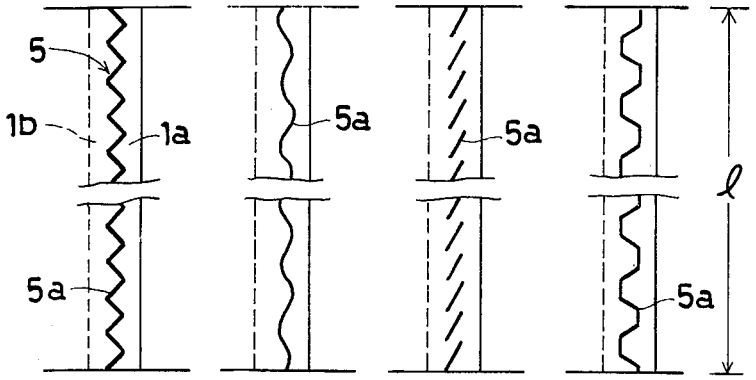
FIG.5
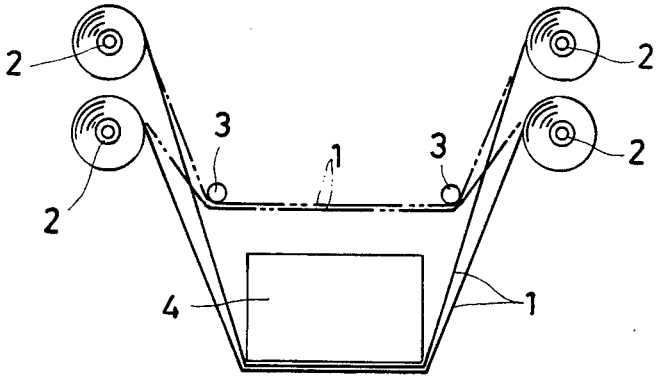
FIG.6
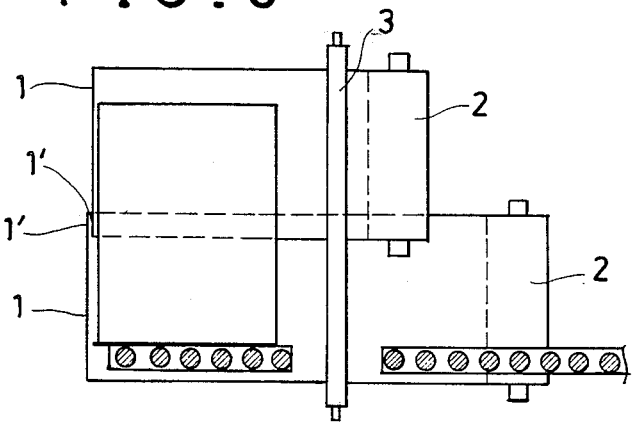

PROCESS FOR PACKAGING ARTICLE WITH FILM

This application is a continuation of application Ser. No. 048,414, filed 5/11/87, now abandoned.

DETAILED EXPLANATION OF THE INVENTION

This invention relates to a process for packaging various kinds of articles with a synthetic resin film.

As for a packaging technique of this kind, there has been hitherto known such a type as described below.

Namely, a thermoplastic film is used for a material for packaging an article, and, as shown in FIG. 9A, the film a is wound on a pair of rollers b, so as to be extended between the two rollers b, and this film a is wrapped, at its intermediate region, around an article c in such a manner that the article c is pushed forward through a space formed between the two rollers b, and the resultant overlapped portions of the intermediate region of the film a wrapping the article c are fused together and cut by a fusing and cutting machine d, so that there is obtained the packaged article c wherein the packaing film a has a fused overlapped end portion connected together through a fused adhesion line e, as shown in FIG. 9B, and, on the other hand, the resultant separate opposite side regions of the film a connected to the rollers b are also fused together, at their cut end portions, so as to be connected through a fused adhesion line e to form an intermediate region of the film extended between the rollers for being ready for the next packaging operation. Accodingly, by repeating the foregoing packaging operations, there is obtained the resultant packaged article with the overlapped end portions having the fused adhesion lines e, as shown in FIG. 9B.

If the film is a shrinkable film, the packaged article is then introduced into a heating chamber f and is heated so that the film a may be shrunk to become adhered closely to the article c for obtaining a packaged product, as shown in FIG. 9C.

In general, the width of the film a to be used is larger than the width of the article c so that by the shrinkage caused by the heat treatment, margin regions a' thereof are shrunk to be adhered closely to the peripheries of both end surfaces of the article so as to have a frame-shaped cover portion for protecting the article, as shown in FIG. 9C.

According to the foregoing conventional packaging process, the overlapped end portions of the packaging film are protruded outwards perpendicularly to the surface of the article as clearly shown in FIG. 10, and are fused together to form a fused adhesion line e. However, the fused overlapped portions are comparatively weak at this fusion adhesion line e thereof, because the overlapped portions are weakened by the fusing adhesion treatment. Therefore, if the fused adhesion line is subjected to such a pulling force in the opposite directions of the arrows shown in FIG. 10, that is, any external force or a shrinkage force of the film caused by the heat treatment thereof, it often happens that the film is broken at the fused adhesion line e. Accordingly, it is necessary to use a packing film is comparatively thick and strong.

This invention has for its object to provide a packaging process for removing the foregoing defect caused by the weakening of the fused adhesion line as involved in the conventional packaging process, and obtaining a durable fused adhesion line. This in a packaging process is of the type wherein a synthetic resin film, which is wound on a pair of rollers, respectively, and is extended between the two rollers, is wrapped, at its intermediate region, around an article fed through a space formed between the two rollers. The resultant overlapped portions of the intermediate region of the film are fused together and cut, so that a packaged article is obtained, and at the same time, the resultant separate opposite side regions of the film connected to the rollers are fused together, at their cut end portions, so as to be connected in line with each other through a fused adhesion line to form an intermediate region of the film extended between the two rollers which is ready for the next packaging operation. The invention is characterized in that the foregoing overlapped portions of the intermediate region of the film are arranged generally in parallel to a surface of the article and are fused together in a lateral direction relative to the film to form such a fused adhesion line which is continuous one that or and intermittent one that is longer than the width of the film.

In the packaging process of this invention, the overlapped portions of the film are fused together under a tense or loose condition thereof. As for the packaging film, any of an ordinary type, for example, a stretch type or a shrinkable type, may be used.

BRIEF EXPLANATION OF THE DRAWINGS

FIG. 5 is a plan view of another embodying example of the invention, FIG. 6 is a side view of further embodying example of the invention.

Figure 1A:
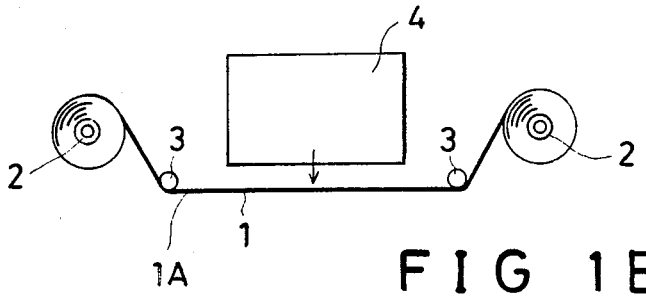
FIGS. 1A, 1B are diagrams for generally explaining the packaging steps of one embodying example of a packaging process according to the invention.

Embodying examples of this invention will now be explained with reference to the accompanying drawings:

As shown in FIG. 1A, a thermoplastic synthetic resin film 1 is wound on a pair of rollers 2, so as to be extended under tension between the two rollers 2 through a pair of contact rollers 3, and under this condition, an article 4 to be packaged is placed on a roller conveyer and is pushed to be fed in the direction shown by an arrow, through a space formed between these rollers, so as to push forward an intermediate region of the film 1.

Figure 1B:
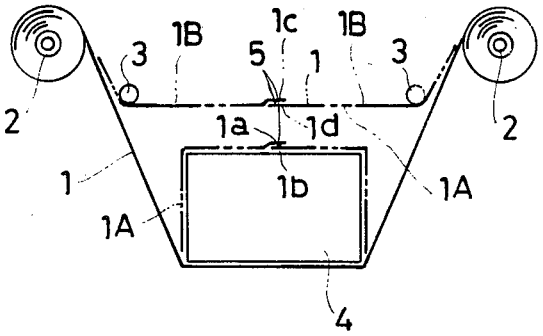
Figure 2:
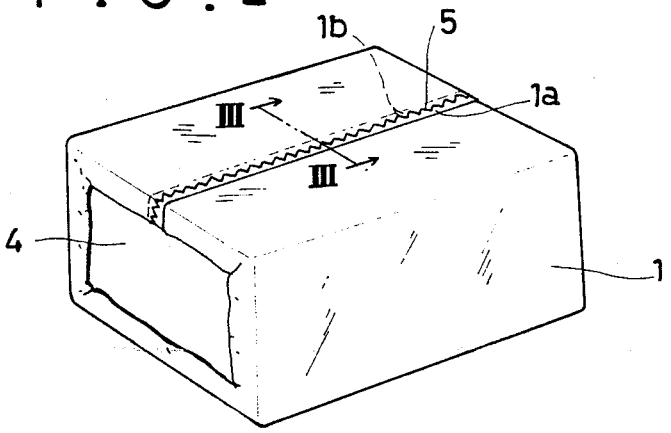
FIG. 2 is a perspective view of a packaged article obtained by the process of the invention.

Accordingly, the film 1 is wrapped, at the intermediate region 1A, around the article 4 so as to embrace the same, and the resultant mutually embraced portions, that is, both end portions 1*a*, 1*b* of the intermediate section 1A of the film 1 are fused together to form a fused joint line 5 in the width direction of the film 1, and are cut to obtain the resultant separate opposite side regions 1B of the film 1 connected to the rollers 2, so that there is obtained the packaged article 4. On the other hand, the separate opposite side regions 1B, of the film 1, that are separated from the intermediate region 1A' of the film packaging the article thereof, are fused together at their cut end portions 1*c*, 1*d* to form a fused adhesion line 5 so as to form a new intermediate region 1A of the film extended between the two rollers 2, which is ready for packaging of the next article 4, as shown by imaginary lines in FIG. 1B. FIG. 2 shows the resultant packaged article 4.

Figure 3A:
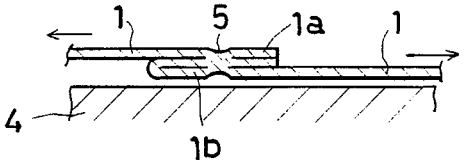
FIG. 3A is a sectional views taken along the line III—III in FIG. 2 for illustrating the section of the fused adhesion line of overlapped portions of the film packaging the article.
Figure 3B:
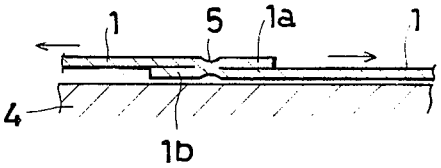
FIG. 3B is a sectional view of another example similar to FIG. 3A, FIGS. 4A, 4B, 4C, 4D are plan views for illustrating various shapes of the fused adhesion lines formed in accordance with the invention.

The foregoing fused overlapped portions 1*a*, 1*b*, that is, the opposite end portions 1*a*, 1*b* of the intermediate region 1A' of the film 1 packaging the article 4, are laid along the surface of the article 4 so that the overlapping surfaces thereof may be in parallel with such a pulling force in directions shown by arrows that is generated by an external force applied thereto or at the time of shrinking of the packaging film 1, as shown in FIG. 3A and FIG. 3B.

In this case, the overlapped portions 1*a*, 1*b* mutually fused together at the fused adhesion line 5 are of such a type that the portion 1*b* is two-fold and is overlapped with a single layer of the other portion 1*a*, not folded, as shown in FIG. 3A. Portions 1*a*, 1*b* may be so modified that the portion 1*b* is not folded and a single layer thereof is overlapped with a single layer of the other portion 1*a*, as shown in FIG. 3B.

In either case, these overlapped portions 1*a*, 1*b* are fused together to form the fused adhesion line 5 in the width direction of the film 1 so that the line 5*a* has a length longer than the width l of the film 1, such as zigzag-formed line one shown in FIG. 4A, the arc wave-formed line shown in FIG. 4B, the intermittent slash-formed line shown in FIG. 4C, the trapezoid or tooth-formed line shown in FIG. 4D.

If a shrinkable thermoplastic synthetic resin film 1 which is larger in width than the article 4 is used the film is shrunk to be adhered closely to the article 1 by heat treatment, and marginal portions thereof are formed into frame cover film portions adhered closely to the peripheries of the end surfaces of the article as shown clearly in FIG. 2.

It is usual in the packaging process of this invention that a single sheet of film 1 is used as in the foregoing example, but in a case where an especially durable packing is required two sheets of film 1 may be used in a mutually layered condition as shown in FIG. 5, and in a case where a packaging of a larged-sized article is required, it can be considered that two sheets of film 1 are so used as to wrap the same article in such a manner that the end edges 1' of the respective sheets are overlapped as shown in FIG. 6.

FIGS. 7 and 8 show a packaging apparatus for carrying out the process in this invention in accordance with a further preferred embodiment.

In this embodying example, a thermoplastic film of stretchable or shrinkable type or the like is used for a packaging film 1.

The apparatus shown in FIGS. 7A–7E is so constructed that there is provided a pair of rollers 2 between which the film 1 is bridged and on which film 1 is wound. Rolls of the film 1 on the rollers 2 are applied with proper braking force so that an intermediate region 1A of the film 1 may be extended in its tensioned condition between two rollers 2 through the contact rollers 3. Ahead of the extended region 1A of the film 1 a pair of movable rods 6*a*, 6*b* are disposed which are movable inwards and outwards in the mutually opposite right and left directions and are also movable in the upper and lower directions (perpendicularly to the drawing sheet surface). Two pairs of clamping and fusing members 7*a*, 7*b* are movable in the upper and lower directions and are movable to open and close each other. A film cutter 8 is arranged to be advanced and withdrawn in relation to the film 1 by a driving mechanism 8*a* such as an air cylinder or the like.

Figure 7A:
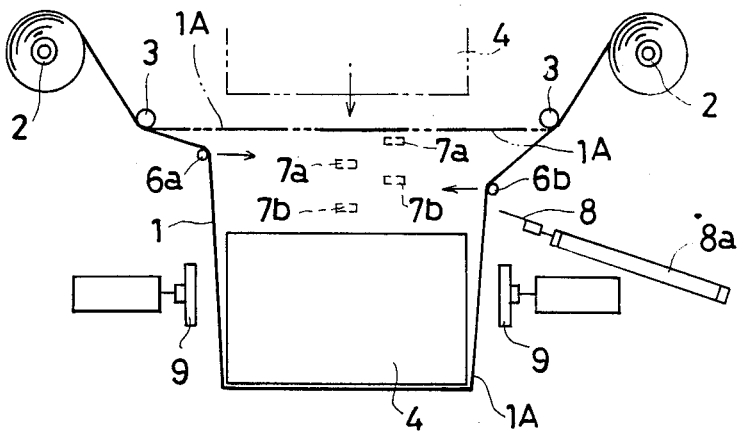
FIGS. 7A–7E are diagrams for explaining operative steps of a packaging apparatus for carrying out the process according to the invention.

With the foregoing apparatus, as shown in FIG. 7A, the article 4 to be packaged is placed on a roller conveyer and is pushed forward through a space formed between the two rollers 2, from the rear side of the film 1 shown by imaginary lines, in the direction of the arrow, so that the intermediate region 1A of the film 1 in its tensioned condition may surround the three side surfaces of the article 4, as shown by solid line in FIG. 7A.

Figure 7B:
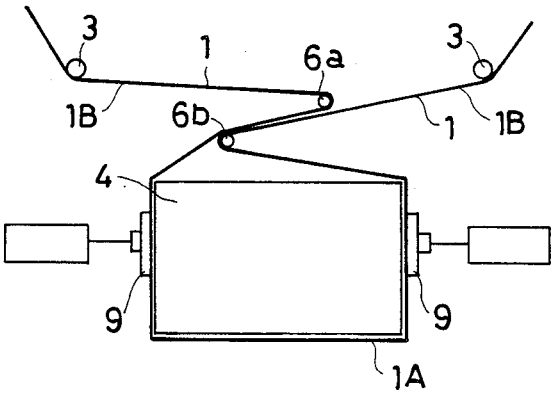

At that time, if necessary, the article 4 is held stationary so that both side surfaces thereof may be held by expansion of a pair of pushing members 9 provided on both sides. Thereafter, by moving the right and left movable rods 6*a*, 6*b* inwards so as to cross each other beyond the center line of the article, such that both side regions 1B of the film 1 extending to the rollers 3 that are in engagement with the rods 6*a*, 6*b* may each be displaced to form an acute angle and to overlie each other beyond the center line to form mutually overlapped bent portions 1B, covering the top surface of the article 4, as shown in FIG. 7B. Thus, the wrapping of the article with the intermediate region 1A of the film 1 extending to rollers 3 is completed. During this wrapping operation, the two pairs of clamping and fusing members 7*a*, 7*b* are set aside at their elevated or lowered positions so as not to obstruct the foregoing wrapping operation.

Figure 7C:
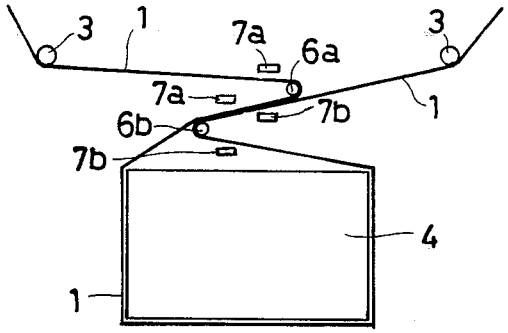

After completion of the foregoing wrapping operation, the two pairs of clamping and fusing members 7*a*, 7*b* are moved forward to be so positioned as to be opposite to the respective folded back and overlapped film regions of the wrapping film as shown in FIG. 7C.

Figure 7D:
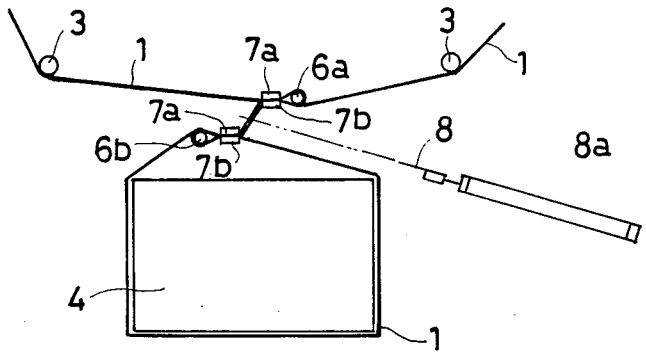

Thereafter, as shown in FIG. 7D, each pair of clamping and fusing members 7*a*, 7*b* is closed, so that the respective three film layers therebetween are used together in the lateral direction of the film to form respective fused adhesion lines 5, each of which is longer in length than the width of the film, and in addition the two layers of the middle portion between the two fused adhesion lines 5 is cut by the cutter 8. The time of cutting by the cutter 8 may be either before, during or after the fused adhesion operation.

Figure 7E:
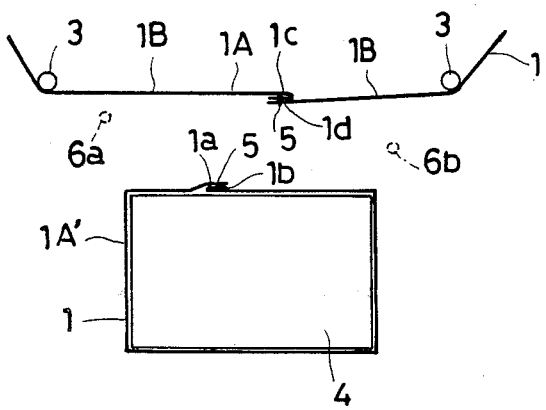

After the completion of the foregoing fusing and cutting operations, the movable rods 6*a*, 6*b* are moved upwards or downwards to slip off from the folded back region of the film 1, and the two pairs of the clamping and fusing members 7*a*, 7*b* are opened and withdrawn to the original inactive waiting positions. As a result, the article 4 is packaged tightly with intermediate region 1A' of the film 1 separated from the film connected to the two rollers 2, and at the same time, there is, on the other hand, obtained the resultant intermediate region 1A of which the overlapped cut end portions 1c, 1d are fused together. Namely, the resultant intermediate region 1A of the film 1 extends in its tensioned condition between the rollers 2 and against the contact rollers 3, ready for the next packaging operation for the next article, as shown in FIG. 7E. Thereafter, the packaged article is taken away from the position shown in FIG. 7E, and then the foregoing packaging procedures as shown in FIGS. 7A–7D are repeated for achieving a continuous packaging process.

If a shrinkable film 1 is used, a packaged article is introduced into a heating chamber so that the packaging film 1 may be shrunk to obtain a closely fit packaged article.

The fused adhesion overlapped portions 1a, 1b of the film 1 obtained by the foregoing embodiment is of the type that, as shown in FIG. 3A, the overlapped portion 1b thereof dconnected to the roller 2 on one side is two fold that is, two layers, and the overlapped portion 1a thereof connected to the roller 2 on the other side is a single layer.

In addition, the overlapped portions 1a, 1b are fused together in their tensioned condition, and accordingly the resultant fused joint line 5 of the resultant fused joint overlapped portions 1a, 1b is subjected to a pulling or tearing force in addition to being weakened by the fusion of the film, so that the overlapped portions 1a, 1b are subject to be broken at that fused joint line 5. Therefore, it is preferable that the overlapped portions 1a, 1b be joined together in their loose condition.

Next, another embodying example for achieving the object of the invention will be explained with reference to FIGS. 8A–8J.

FIGS. 8A–8J show a packaging apparatus for carrying out the foregoing preferable packaging process of the invention. The apparatus is so constructed that a pair of opposite movable rods 9a, 9b, movable to open and close, and another pair of opposing movable rods 9c, 9d, movable to open and close, are disposed on both sides of the right and left end portions of the intermediate region 1A of the film 1 extended in its tensioned condition between the two contact rollers 3, and additionally a pair of movable rods 9e, 9f are disposed respectively on the left side and on the right side and respectively in front of the movable rod 9b and in front of the movable rod 9d, and sucker members 10a, 10d, 10e, 10f, each swingable by a driving means (not shown) such as an air cylinder mechanism or the like, are provided near the foregoing movable rods 9a, 9d, 9e 9f. In addition, clamping members 11a, 11b, arranged to be advanced and withdrawn by respective air cylinders 12, are disposed respectively on the left side and the right side and on between the movable rods 9b, 9e on the left side and the movable rods 9d, 9f on the right side. The movable rods 9a, 9b, 9e and the air cylinder 12 on the left side, and the movable rods 9c, 9d, 9f and the air cylinder 12 on the right side are mounted on the respective base tables 13a, 13b which are synchronously movable to the right and left in the mutually opposite directions so as to approach one another or diverge from one another, and additionally a sucker box 14 is so provided as to be movable to advance to or retreat from a middle position intermediate between the movable rods 9e, 9f.

Figure 8A:
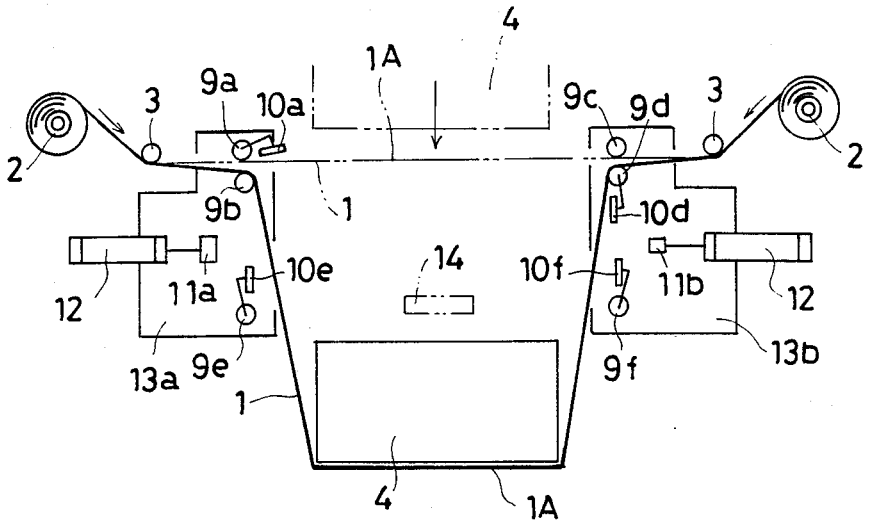
FIGS. 8A–8J are diagrams for explaining operative steps of another packaging apparatus for carrying out the process according to the invention.
Figure 8B:
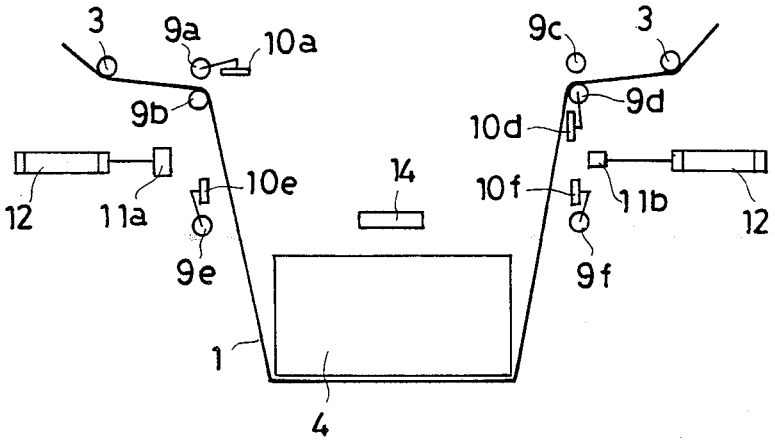
Figure 8C:
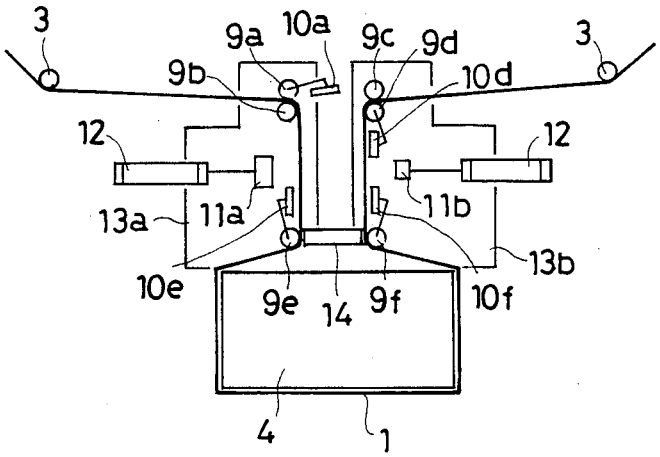
Figure 8D:
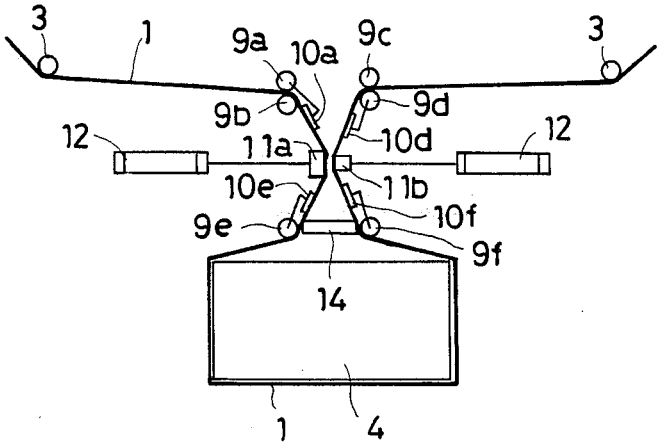
Figure 8E:
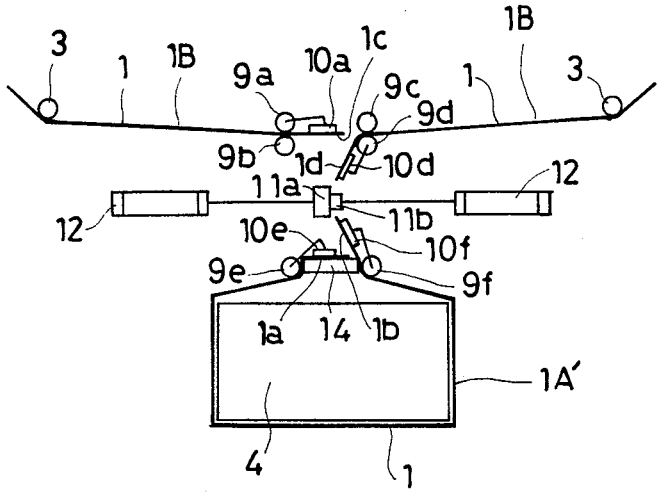
Figure 8F:
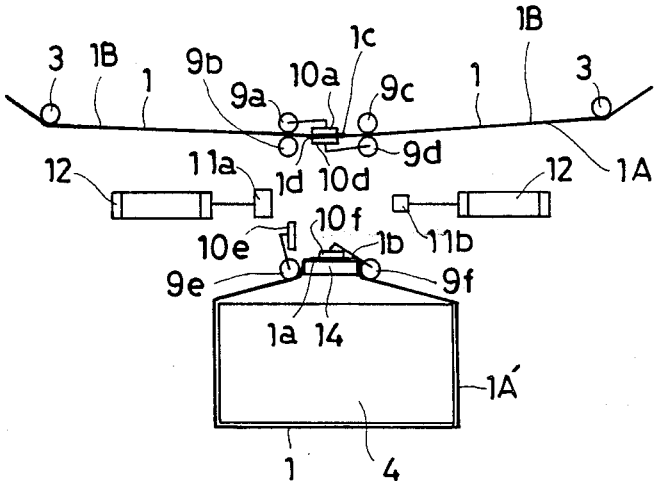
Figure 8G:
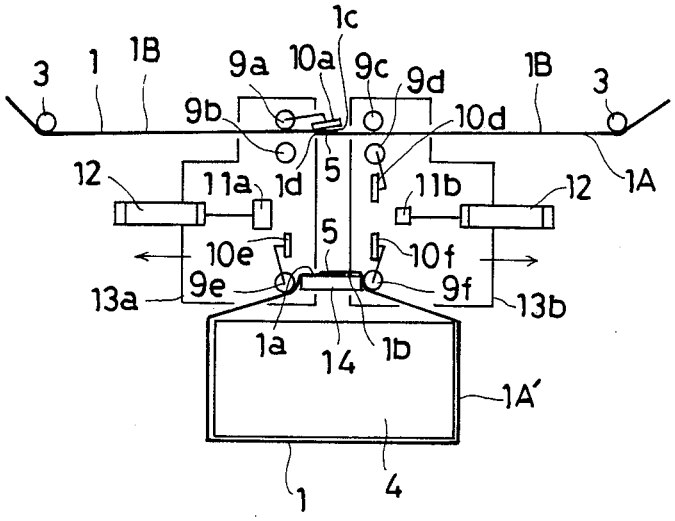
Figure 8H:
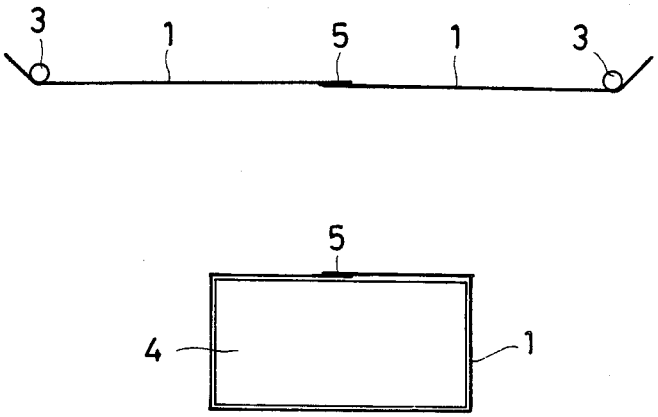
Figure 8I:
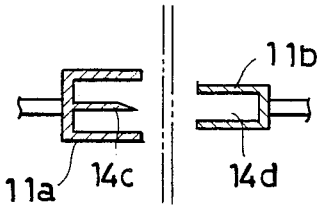
Figure 8J:
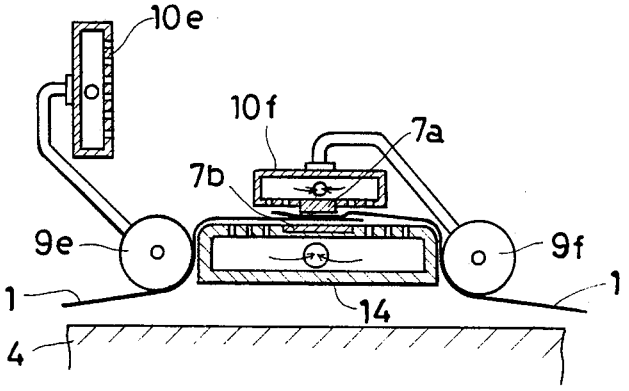
Figure 9A:
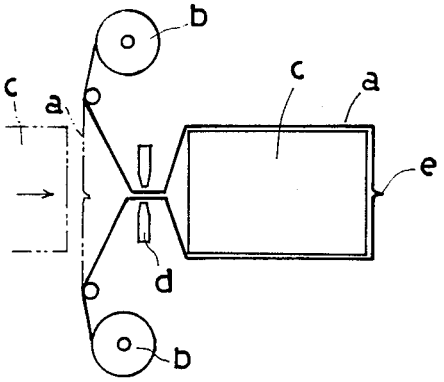
PRIOR ART FIG. 9A
FIGS. 9A, 9B, 9C are diagrams for explaining operative steps in a conventional process.
Figure 9B:
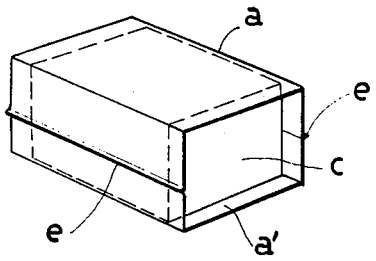
Figure 9C:
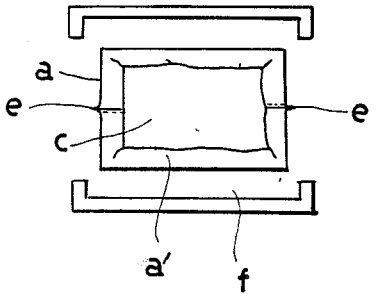
Figure 10:
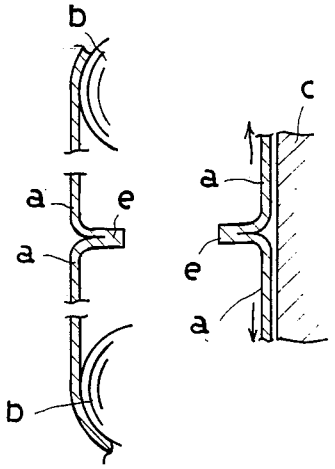
PRIOR ART FIG. 10
FIG. 10 shows sectional views of fused adhesion portions by the conventional process.

With the foregoing apparatus, the packaging process of this invention is carried out in such a manner that, after the article is fed into a space formed between the contact rollers 3, during which the article pushes the intermediate region 1A of the film 1 forward so that the intermediate region 1A surrounds the three side surfaces of the article 4, as shown in FIG. 8A, the sucker box 14 is advanced to its operative position shown by the solid line in FIG. 8B, and then, the base tables 13a, 13b on both sides are moved inwards so that the right and left side regions of the film that extend to the respective contact rollers 3 from both outsides of the article 4 may be displaced towards the center line and each other. The side film regions are displaced under pressure contact with the movable rods 9b, 9d and the movable rods 9e, 9f, which are being moved inwards until the movable rods 9e, 9f are brought into contact with the respective side surface of the sucker box 14 for holding the respective side film regions there between. In this condition the pair of movable rods 9a and 9b and the pair of movable rods 9c and 9d are closed respectively for holding the film 1 therebetween as shown in FIG. 8C, and thereafter, the air cylinders 12 on both sides are driven to advance the clamping members 11a, 11b, and synchronously with this, the sucker members 10a, 10d, 10e, 10f are swung inwards for holding the respective opposing film regions by suction, as shown in FIG. 8D. In this condition, the clamping members 11a, 11b are further advanced so that a cutting blade 14c, provided in one of the clamping members 11a, 11b, may be inserted into a cutting blade receiving groove 14d formed in the other clamping member to cut the film 1, as depicted in FIG. 8I. As a result, the resultant cut free end portions of the film region 1A' of the film covering the article 4, and the resultant cut free end portions of the resultant separate opposite regions 1B of the film that are apart from the intermediate region 1A' packaging the article 4, but are connected to the contact rollers 3, are held, by suction, by the sucker members 10e, 10f, and sucker members 10a, 10d, respectively. Thus on the one hand, a pair of free end portions 1c, 1d projecting from the respective film portions clamped between the movable rods 9a, 9b, and the movable rods 9c, 9d, respectively, are obtained in their loose condition released from the tensioned condition previously applied thereto and, on the other hand, a pair of free end portions 1a, 1b projecting from the film regions clamped between the movable rods 9e, 9f and the side surfaces of the sucker box 14 respectively are obtained in their loose condition, released from the tensioned condition previously applied thereto, as shown in FIG. 8E. Thereafter, the sucker member 10a holding the free end portion 1c of the film 1 is swung counterclockwise so that the free end portion 1c of the film held thereby may be moved to a position which is in alignment with the line of the opposite right and left side portions 1B of the film extended between the contact rollers 3 on both sides, and in addition the sucker member 10e holding the free end portion 1a of the film is swung counter clockwise so that the free end portion 1a may be put on and sucked by the surface of the sucker box 14. Then the suction operation of the sucker member 10e on the free end portion 1a is stopped so that the free end portion 1a is transferred onto the sucker box 14, and then the sucker member 10e is swung back to its original position. Thus, the free end portion 1a in its loose condition is held by box 14, as shown in FIG. 8E. Thereafter the sucker member 10d is swung clockwise towards the sucker member 10a, and the sucker member 10f is swung counter clockwise towards the surface of the sucker box 14 so that the free end portion 1d sucked by the sucker member 10d may be placed against the free end portion 1c held by the sucker member 10a and the free end portion 1*b* held by the sucker member 10*f* may be placed against the free end portion 1*a* on the surface of the sucker box 14, as shown in FIG. 8F and 8J.

Thus, the respective overlapped free end portions 1*a*, 1*b* and 1*c*, 1*d* are fused together in the resultant loose condition, that is, in the width direction of the film, to form the respective fused joint line 5 that is longer than the width of the film, by respective pairs of fusing members 7*a*, 7*b* provided on the pair of sucker members 10*a*, on the sucker member 10*f* and the sucker box 14, respectively. As a result, there is obtained a packaged article 4 in which the article 4 is packaged with the intemediate region 1A' of the film 1 having the overlapped cut end portions 1*a*, 1*b* fused together, and, on the other hand, there is established a new intermediate region 1A having a fused adhesion line 5 interconnecting the cut end portions 1*c*, 1*d* of the separate opposite side regions 1B of the film 1 connected to the rollers 3. Thereafter as shown in FIG. 8G, the sucker members 10*d*, 10*f* are swung back to their original positions, the respective pairs of movable rods 9*a*, 9*b*, 9*c*, 9*d* are opened, and the intermediate region 1A of the film 1 is extended in the tensioned condition between the contact rollers 3. Additionally, the base tables 13*a*, 13*b* are moved outwards in the opposite directions shown by the arrows, the sucker box 14 is retracted to its original position and the apparatus is restored to the original condition shown in FIG. 8A, ready for use in the next packaging operation. At the same time there is obtained the article 4 packaged with the film 1 wrapped snugly around it, as shown in FIG. 8H, and the fused joined overlapped portions of the film enwrapping the article are obtained in their flat condition along the surface of the article 4.

Thus, according to this invention, the overlapped end portions of the synthetic resin film wrapped around the article are set in parallel with the surface of the article, and are fused together in the lateral direction of the film so as to form a fused adhesion line which is longer than the width of the film, so that there can be used a wrapping film which is reduced in thickness as compared with that used in the case of the foregoing conventional packaging process, and the strength of the fused overlapped portions of the film packaging the article is increased in strength and resistance to a tearing force, owing to the elongated length of the resultant fused adhesion line of the fused overlapped porions thereof. Owing to the fact that the overlapped end portions are laid along the surface of the article, the film is prevented from breaking at the fused adhesion line at the time of the shrinking of the film. As a result, a packaging film can be used which is smaller in thickness and strength by about 50% relative to that used in the conventional packaging process.

I claim:

1. A process for continuously packaging an article with a shrinkable synthetic resin film comprising the steps of winding said film on a pair of rollers so as to be extended between the two rollers, wrapping an article by moving it into an intermediate region of the film, between the two rollers, overlapping end portions of the intermediate region of the film extending behind the article, cutting the resultant overlapped end portions, fusing together the cut overlapped end portions in the lateral direction of the film to form a fused adhesion line comprising a plurality of segments and having a summed length greater than the width of the film, fusing the cut overlapped separate opposite side regions of the film connected to the two rollers together, to obtain a seam within a new intermediate region to be extended between the two rollers which is ready for the next packaging operation, and shrinking the wrapped film so that the fused end portions of said overlapped portions lie adjacent to and parallel to a surface of the article being wrapped, wherein the film is first wrapped around the article while kept in a tensioned state, and the overlapped portions thereof are thereafter put in an untensioned state, and said overlapping comprises the folding of the foremost end portion of one of the overlapped portions upon itself so as to be inserted between said overlapped portions, and said foremost end portion and both of said overlapped portions then being fused together to form each said adhesion line and said seam from three layers of film with said folded portion being in the center.

2. The process for packaging an article with a film as defined in claim 1, wherein the synthetic resin film is made of a thermoplastic resin which is stretchable.

3. The process for packaging an article with a film as defined in claim 1, wherein the overlapped portions of the film are fused together in a tensioned state.

4. The process as defined in claim 1, wherein the synthetic resin film is made of a thermoplastic resin which is shrinkable.

5. The process as defined in claim 1, wherein the overlapped portions of the film are fused together in an untensioned state.

6. The process as defined in claim 1, wherein said plurality of segments are connected to form a single continuous line.

7. The process as defined in claim 1, wherein said plurality of segments are not connected.

8. The process as defined in claim 1, wherein fusion of the overlapped portions of the wrapped film is performed by a first fusing means located inside said wrapped film and a second fusing means located outside said wrapped film.

* * * * *